United States Patent [19]

Cardell

[11] Patent Number: 4,489,898

[45] Date of Patent: Dec. 25, 1984

[54] METHOD AND APPARATUS FOR INITIATING THE WINDING OF FILAMENTARY MATERIAL UPON A WINDER TUBE

[75] Inventor: Max L. Cardell, Shelby, N.C.

[73] Assignee: Celanese Corporation, New York, N.Y.

[21] Appl. No.: 430,561

[22] Filed: Sep. 30, 1982

[51] Int. Cl.[3] ..... B65H 54/02; B65H 54/34

[52] U.S. Cl. ..... 242/18 PW; 242/35.5 R

[58] Field of Search ..... 242/18 PW, 18 DD, 18 EW, 242/35.5 R, 35.5 A, 18 A

[56] References Cited

U.S. PATENT DOCUMENTS

| | | | |
|---|---|---|---|
| 1,966,159 | 7/1934 | Beckman | 242/18 PW |
| 3,198,445 | 8/1965 | Hull, Jr. et al. | 242/18 PW |
| 3,690,577 | 9/1972 | Schroeder | 242/18 PW |
| 3,792,818 | 2/1974 | Bauer et al. | 242/18 PW |
| 3,819,123 | 6/1974 | Luz | 242/18 PW |
| 3,964,690 | 6/1976 | Tauleigne | 242/18 PW |
| 4,002,307 | 1/1977 | Turk et al. | 242/18 PW X |
| 4,023,741 | 5/1977 | Schar | 242/18 PW X |
| 4,052,017 | 10/1977 | Schar | 242/18 DD X |
| 4,093,135 | 6/1978 | Hermanns | 242/18 PW |
| 4,108,388 | 8/1978 | Schar | 242/18 PW X |

FOREIGN PATENT DOCUMENTS

| | | | |
|---|---|---|---|
| 1175965 | 1/1970 | United Kingdom | 242/18 PW |

*Primary Examiner*—Stanley N. Gilreath
*Attorney, Agent, or Firm*—Robert J. Blanke

[57] ABSTRACT

Winding of filamentary material upon a winder tube is initiated by inserting the filamentary material into a slot which prevents the filamentary material from being traversed along the axis of the tube. The slot is moved relative to a gate such that the gate prevents egress of the filamentary material from the slot. The filamentary material is inserted into a pinch groove of the tube, and the tube is rotated to form a waste bunch of filamentary material at the end of the tube. After a preset interval, the slot is moved relative to an ejector cam whereupon the latter ejects the filamentary material from the slot. The filamentary material is then engaged by a traversing guide which traverses the filamentary material along the axis of the tube.

6 Claims, 11 Drawing Figures

METHOD AND APPARATUS FOR INITIATING THE WINDING OF FILAMENTARY MATERIAL UPON A WINDER TUBE

BACKGROUND AND OBJECTS OF THE INVENTION

The present invention relates generally to the high speed winding of filamentary material onto bobbins or spools to form packages of filamentary material. More particularly, it relates to the handling of man-made filament yarn during the initial stages of winding a package.

The manufacture of man-made or synthetic filament yarns is typically achieved by extruding a molten polymer, such as polyester, polyamide, etc., through hole(s) in a spinneret and then cooling the filament(s) thus formed. Thereafter, the filaments may be gathered together to form a multi-filament yarn and, possibly after further treatment, are wound onto a tube so that a yarn package is formed.

Winding of the yarn is performed mechanically by winders which rotate one or more tubes to wind-up the yarn while traversing the yarn along the tube axis to achieve a uniform thickness of yarn being wound.

A doffing/donning operation (i.e., replacement of the yarn packages with empty tubes on the winder) is often performed manually by an operator who (i) severs the yarn, (ii) stops the rotary drive to the packages, (iii) replaces the packages with empty tubes, (iv) re-establishes the rotary drive between the winder drive head and the tubes, and (v) rethreads the yarn onto the empty tubes. Severing of the filamentary yarn is typically performed with scissors while the inlet of a suction or aspirator gun is held against the yarn at a location above the point of serving. Once the yarn is severed, the trailing end of the yarn is wound onto the yarn package, while the newly formed leading end of the yarn is sucked into the aspirator and fed to a waste collector. The suction gun is then placed onto a holder while the yarn packages are being replaced by empty tubes. When the empty tubes attain full speed, the operator manipulates the suction gun to attach the yarn to the rotating tubes so that this winding operation may begin.

In order to economize such winding operations, it has heretofore been proposed to mechanize the doffing and donning operations to a certain extent by providing a mechanism which automatically severs, aspirates and rethreads the yarn. Exemplary of proposed mechanisms of that type are the disclosures in U.S. Pat. No. 4,023,741 issued to Schar on May 17, 1977; U.S. Pat. No. 4,052,017 issued to Schar on Oct. 4, 1977; and U.S. Pat. No. 4,108,388 issued to Schar on Aug. 22, 1978.

One of the operations to be performed during a typical threading of yarn onto an empty tube is the forming of a so-called yarn "transfer tail" at an end of the tube which enables the end user of the yarn to tie together a series of packages to form a continuous threadline for subsequent uninterrupted yarn processing such as knitting, weaving, creeling, etc. The transfer tail is formed at the beginning of a winding sequence. One manner of forming such a "tail" is to provide a tail making guide on the winder. The tail making guide includes a slot which temporarily captures the yarn before the latter is installed within the pinch groove of an empty tube. The presence of the yarn within the slot prevents the yarn from being picked up by the standard traversing guide, i.e., the yarn is held against movement along the axis of the tube. Accordingly, a so-called "waste bunch" of yarn is wound in close order upon the package. After a preset period, the tailing guide ejects the yarn from the slot and the yarn is picked-up by the traversing guide, thereby forming a "tail" upon the tube. The end user of the yarn cuts the tail from the waste bunch (the waste bunch may constitute yarn which has experienced a tension change during the threading procedure) and ties same to the leading yarn end of another package to form the continuous threadline.

One problem which tends to occur involves a premature egress of the yarn from the slot in the tailing guide. That is, as the yarn is caught in the pinch groove of the empty tube, the initial rotation of the tube causes the yarn to become slackened. This slackening often dislodges the yarn from the slot before a proper waste bunch has been formed.

It is, therefore, an object of the present invention to minimize or obviate problems of the above-discussed sort.

Another object is to prevent premature egress of the filamentary material from a tail making guide.

A further object is to temporarily block yarn from exiting a tail making guide to insure that a proper waste bunch and transfer tail are properly formed.

SUMMARY OF THE INVENTION

These objects are achieved by the present invention which involves a winder for filamentary material and a method for winding filamentary material. The winder comprises a mount for rotating a tube about a longitudinal axis to wind-up filamentary material. A traversing guide guides the filamentary material for traversing movement along the tube axis to effect a helical winding of the filamentary material upon the tube. A tail making mechanism includes a constraining portion for receiving the filamentary material and constraining the filamentary material against traversing movement along the tube axis during an initial winding interval, in order to form a waste bunch of filamentary material at an end of the tube. The tail making mechanism also includes a blocking portion for blocking egress of the filamentary material from the constraining portion during such initial winding interval. The tail making mechanism further includes an ejector for displacing the filamentary material from the constraining portion at the end of the initial winding interval, whereupon the filamentary material is traversed by the traverse guide.

Such a mechanism assures that during the initial winding interval, the filamentary material will not inadvertently exit the constraining portion.

Preferably, the tail making mechanism comprises a retainer plate which includes a constraining portion in the form of a slot. The slot opens toward the path of travel of the filamentary material to receive the latter and constrain the same against movement parallel to the longitudinal axis of the tube during the initial winding interval. The blocking portion comprises a gate mounted adjacent the winder path. An actuator effects relative movement between the retainer plate and the gate to locate the gate in blocking relationship relative to the filamentary material to prevent egress of the filamentary material from the slot during the initial winding interval. The ejector includes a cam plate having a camming edge disposed adjacent the retainer plate. The actuator effects relative movement between the retainer plate and the cam plate such that the camming edge pushes the filamentary material out of the slot at the end of the initial winding interval.

In a method aspect of the present invention, the filamentary material is inserted into a slot which prevents movement along the axis of the winder tube. Relative movement is produced between the slot and a blocking element such that the blocking element prevents egress of the filamentary material from the slot. The filamentary material is inserted into a pinch groove of the winder tube. The winder tube is rotated for a preset interval to form a waste bunch of filamentary material on the tube. Relative movement is produced between the slot and the blocking element to permit egress of the filamentary material from the slot. The filamentary material is then ejected from the slot and is traversed along the axis of the tube as winding proceeds.

THE DRAWINGS

The objects and advantages of the invention will become apparent from the following detailed description of a preferred embodiment thereof, in connection with the accompanying drawings, in which like numerals designate like elements, and in which.

DETAILED DESCRIPTION OF A PREFERRED EMBODIMENT OF THE INVENTION

Figure 1:
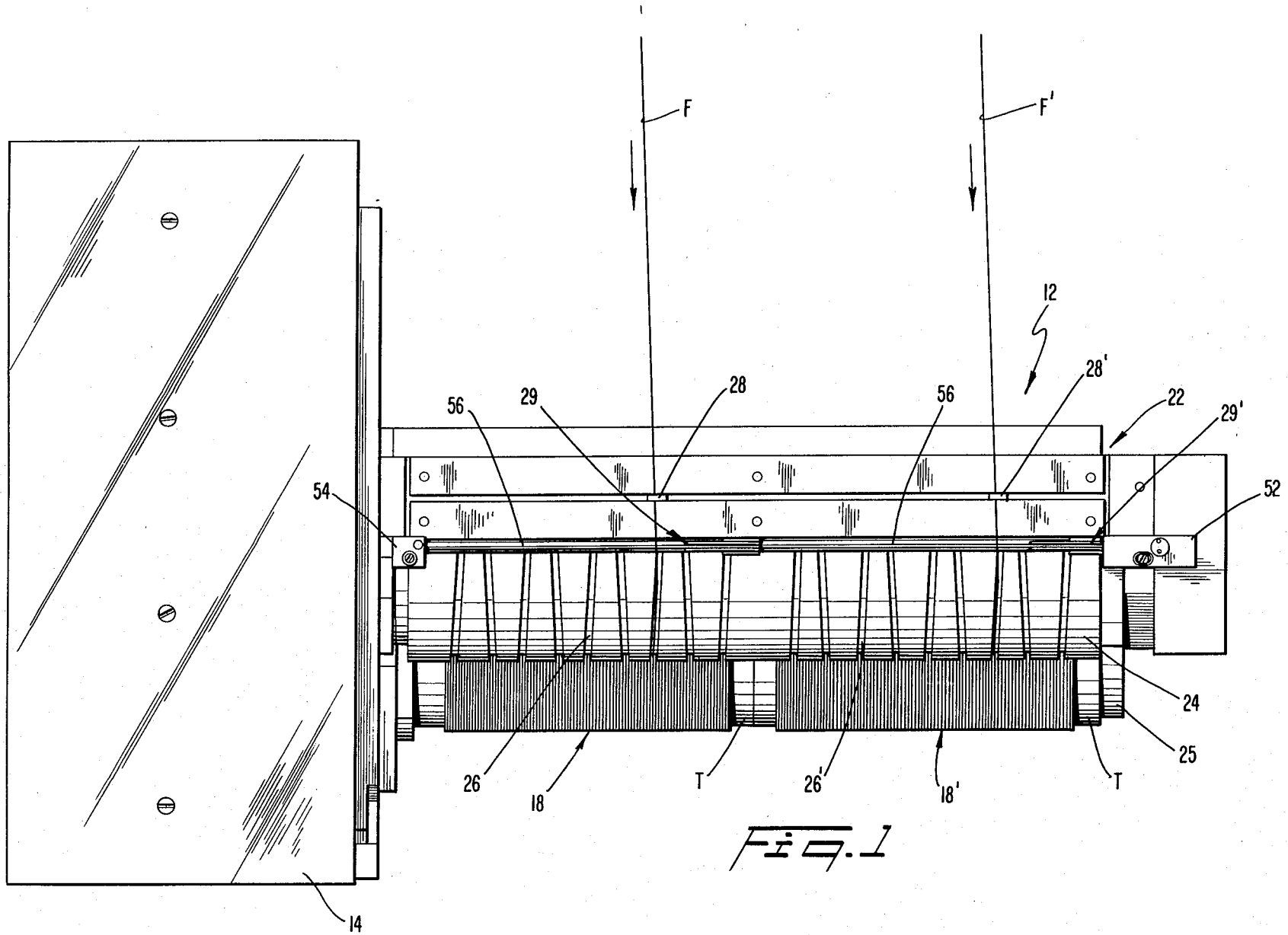
FIG. 1 is a side elevational view of a winder in which the helical winding of two yarns onto winder tubes proceeds in a conventional fashion.

A winder 12 for filamentary material, such as yarn for example, is depicted in FIG. 1. The winder 12 comprises a stationary frame 14 from which projects a yarn package axle or spindle which supports one or more conventional removable tubular packages 18, 18'.

Disposed above the package spindle is a package drive head 22 which is vertically reciprocably carried by the frame 14. Conventional power mechanism (not shown) within the frame 14 are operable to raise and lower the drive head 22. The drive head 22 includes a helically grooved roll 24 mounted for rotation about an axis parallel to the package axle. During a winder operation, one or more yarns F, F' pass downwardly through overhead guides or godets (not shown) and travel within the helical guide grooves 26, 26' of the roll 24 and also within horizontally reciprocable traverse guides 28, 28' disposed above the respective grooves. The grooved roll 24 is rotatably driven and the traverse guides 28, 28' are reciprocated parallel to the package axis to achieve a uniform distribution of the cross-wound yarns along the yarn packages.

The yarn packages are driven by a drive roll 25 mounted on the drive head 22 behind the grooved roll 24. The drive roll rotates the yarn package through frictional contact therewith. As a yarn package fills with wound yarn, the drive head 22 is pushed upwardly by the peripherally accumulating yarn layers while continuing to make peripheral drive contact therewith.

When the packages 18, 18' have been filled, the yarns are cut and aspirated to waste manually or automatically. That is, there may be employed a hand-held suction gun, or an automated system similar to that described in my copending continuation-in-part application Ser. No. 387,903 filed June 14, 1982, and entitled "Methods and Apparatus for Minimizing the Loss of Waste Suction Pressure in Systems Which Aspirate Filamentary Material", the disclosure of which application is incorporated herein by reference. The packages are, in the meantime, removed and replaced by empty tubes T. The yarns are threaded onto the tubes by inserting the yarns into pinch grooves of the tubes. This can be done, for example, by inserting the yarns into conventional throw-on guides (not shown) of the winder. The throw-on guides receive the yarns and are then swung inwardly to carry the yarns into the pinch grooves.

Mounted on the winder above the grooved roll 24 are a pair of tail making guides 29, 29', each having a slot which receives a yarn at the initiation of a winding operation. As a result, the tailing guide prevents the respective yarn from being traversed by the traversing guide 28 (or 28') and the grooved roll 24. Thus, instead of being wound helically upon the tube, the yarn is wound circumferentially to form a so-called waste bunch which can be later discarded. This waste bunch contains yarns which may have experienced a tension change and thus may not be of acceptable quality. After a prescribed interval of circumferential winding, the yarn is ejected from the slot of the tail making guide and is engaged by the traversing guide 28 (or 28') so as to be traversed in a manner forming a so-called transfer tail on the package. This transfer tail enables an end user of the package to couple the yarn of that package to the yarn of another package to form a continuous yarn to be used in an uninterrupted yarn processing operation such as weaving, knitting, creeling, etc.

Figure 2:
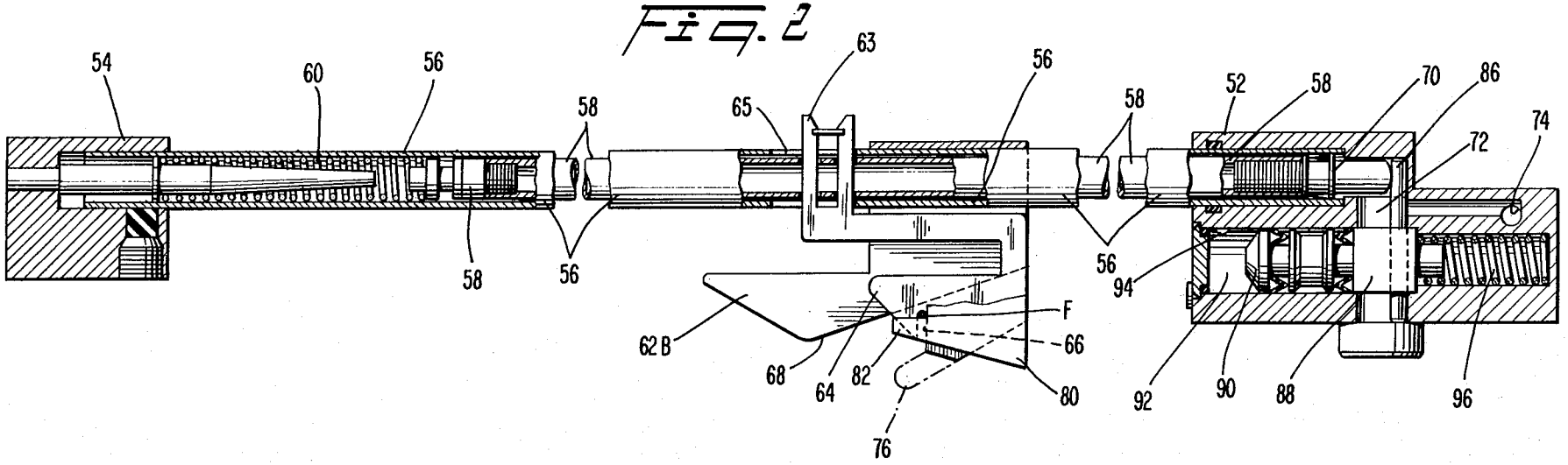
FIG. 2 is a longitudinal sectional view of a tail making mechanism according to the present invention, taken along line 2—2 of FIG. 8, the tail making mechanism being in a position wherein a yarn is blocked against egress from a constraining slot.
Figure 8:
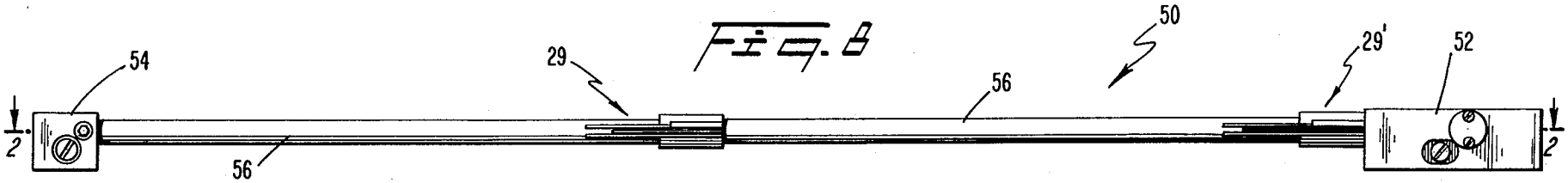
FIG. 8 is a front elevational view of the tail making mechanism per se.
Figure 10:
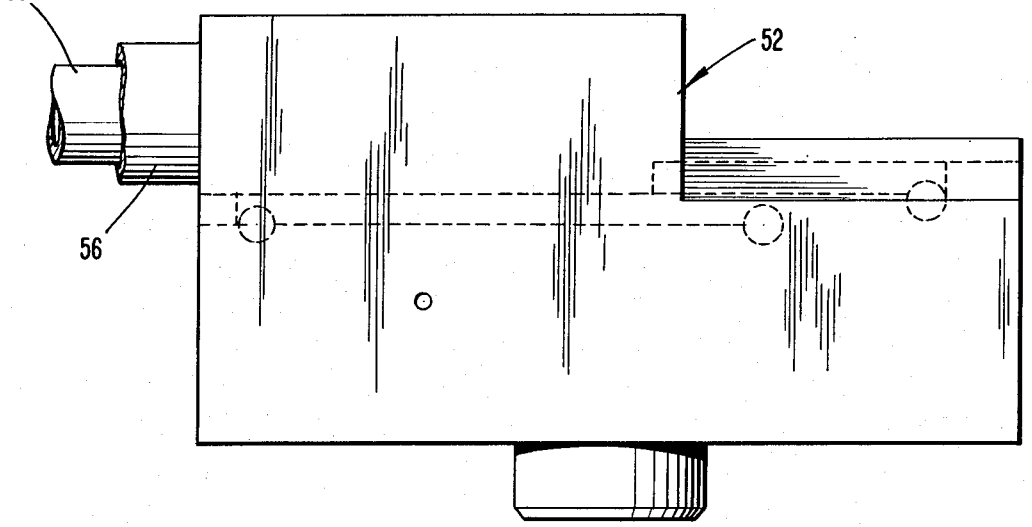
FIG. 10 is a plan view of a primary housing portion of the tail making mechanism.
Figure 9:
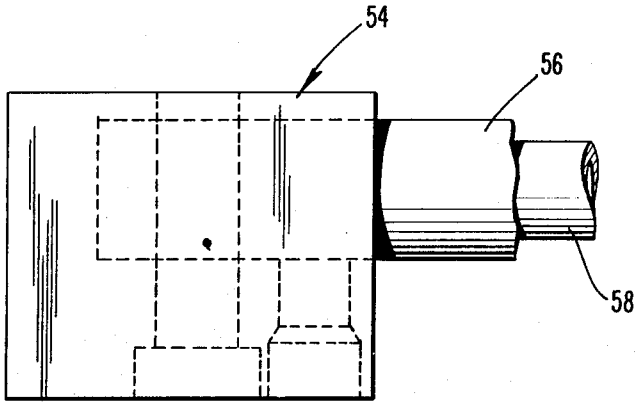
FIG. 9 is a plan view of a secondary housing portion of the tail making mechanism.

The tail making guide assembly 50 (FIG. 8) comprises primary and secondary housings 52, 54 mounted at opposite sides of the drive head 22. A hollow tube 56 interconnects the two housings 52, 54. Movably mounted within the hollow tube 56 is an actuating rod 58 (FIGS. 9 and 10). One end of the rod, disposed adjacent the secondary housing 54, is biased toward the primary housing 52 by a coil compression spring 60 (FIG. 2). The other end of the rod 58 is operably connected to a power mechanism within the primary housing 52 which reciprocates the rod 58 as will be hereinafter discussed. The tail making guides 29, 29' are mounted on the rod 48 for movement therewith. Since both tail making guides 29, 29' are of identical construction, only one will be describe hereinafter in detail.

Figure 3:
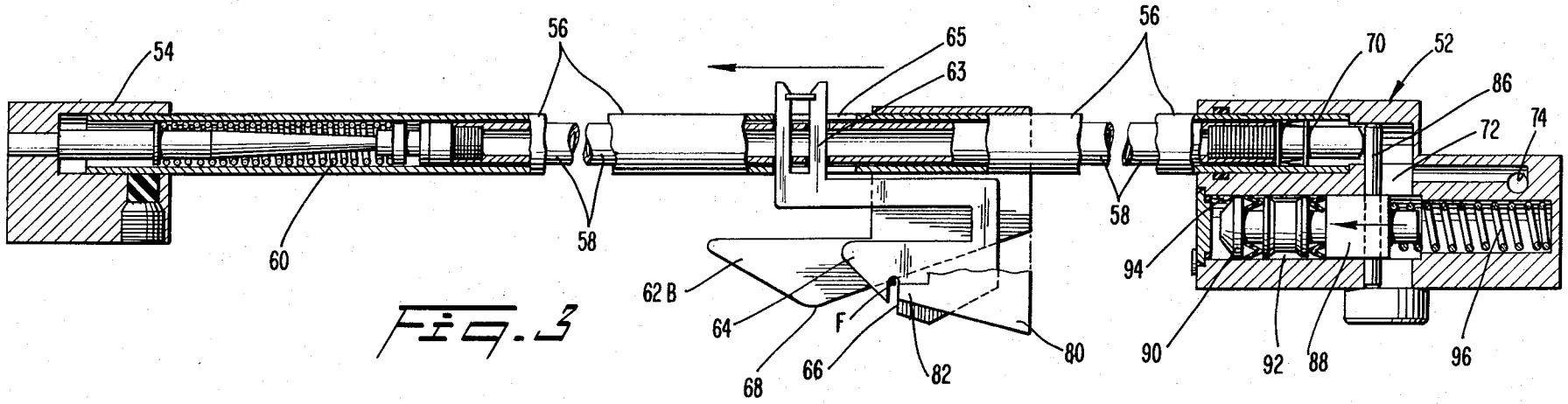
FIG. 3 is a view similar to FIG. 2 wherein the yarn is not blocked against egress from the constraining slot.
Figure 11:
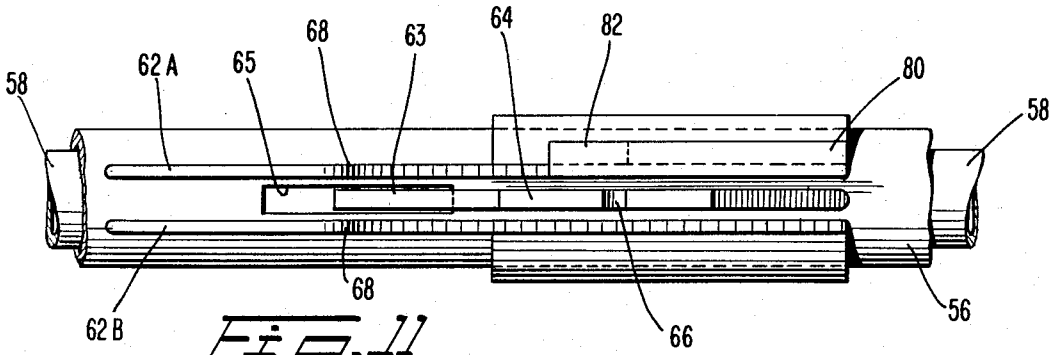
FIG. 11 is an enlarged elevational view of a tail making guide according to the present invention.

The tail making guide 29 (FIG. 3) comprises a multipart assembly which includes a pair of superimposed stationary cam plates 62A, 62B (FIG. 11) and a retainer plate 64 which is reciprocably movable between the stationary cam plates 62A,B (the upper camming plate 62A is not depicted in FIGS. 2 and 3 for the sake of clarity). The cam plates 62A,B are affixed to the tube 56 and are thus stationarily disposed. The retainer plate 64 has a horizontal slot 66 formed therein which is open in a direction facing away from the drive head 22 and is of sufficient width to receive a yarn F. The retainer plate 64 has an extension 63 connected to the movable rod 58 and which is movable within slots 65 in the stationary cam plates 62A,B such that the slot 66 can be moved to a position beyond horizontal front edges 68 of the cam plates (i.e., to the left as viewed in FIG. 7). Those front edges 68 are inclined in a direction causing the yarn to be ejected from the slot 66 when the retainer plate 64 is so moved.

Figure 4:
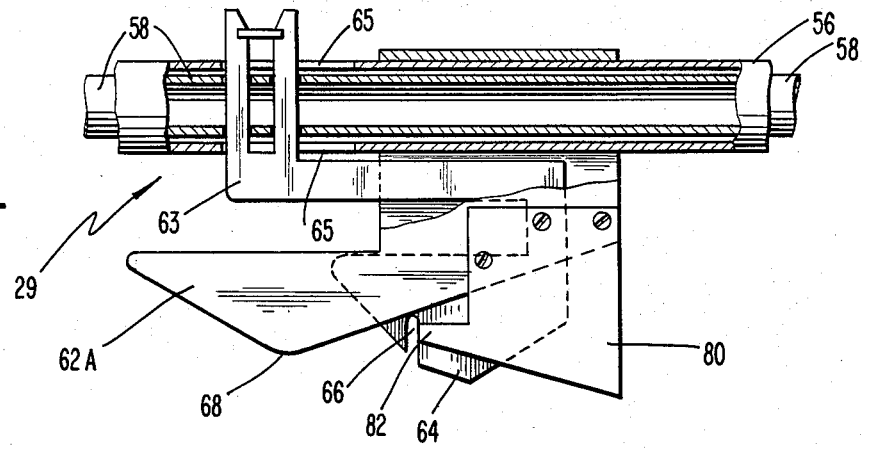
FIG. 4 is a longitudinal sectional view taken through a tail making guide according to the present invention, depicting the guide in its normal rest position awaiting receipt of a yarn, a portion of an upper camming plate being broken away from the sake of clarity.
Figure 7:
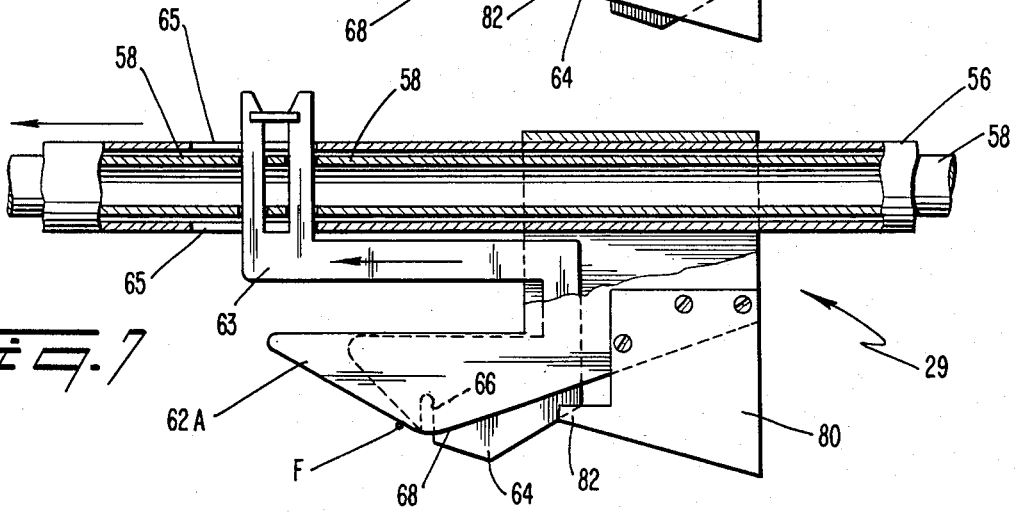
FIG. 7 is a view similar to FIG. 6 after the receiver plate has been shifted in a direction causing the yarn to be ejected from the slot.

Movement of the receiving plate 64 is effected by an air-driven actuating piston 70 (FIG. 2) which is mounted in a chamber 72 of the primary housing 52. The actuating piston 70 is connected to the actuating rod 58. The spring 60 biases the piston 70 to a retracted position (i.e., to the right in FIG. 3) wherein the slot 66 is spaced laterally from the cam plates 62A,B as depicted in FIG. 4. The admission of pressured air via a passage 74 into the chamber 72 behind the actuating piston 7 causes the latter to extend (FIG. 3) and push the slot 66 beyond the cam edges 68 as depicted in FIG. 7.

Figure 5:
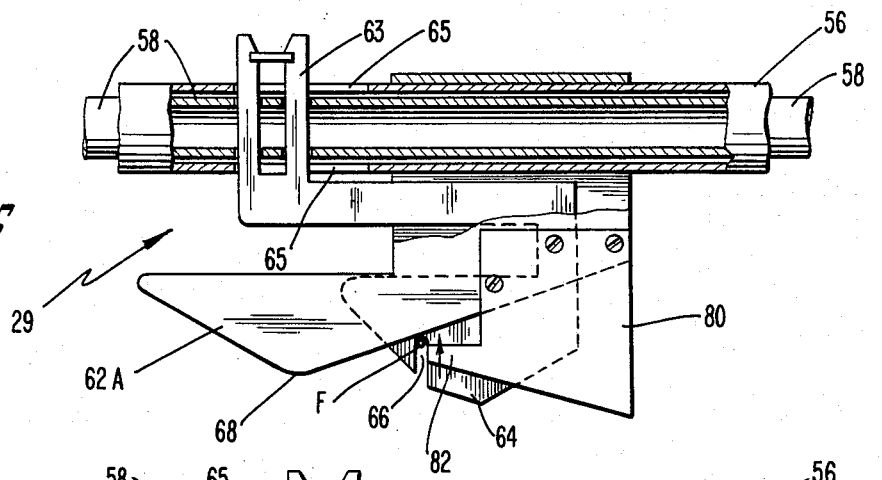
FIG. 5 is a view similar to FIG. 4 after a yarn has been inserted into the slot of a receiver plate of the guide.

The tail making guide mechanism described thus far is basically conventional. In practice, yarn F is inserted into the slot at the beginning of a winding sequence (FIG. 5). If this is done manually, it may be desirable to provide the retainer plate 64 with a projection 76 (shown in broken lines in FIG. 2) which aids in guiding the yarn. It will be appreciated that while the yarn F is disposed within the slot 66, it cannot be traversed along the package axis. Rather, a selected amount of yarn will be wound at the end of the tube to form a waste bunch. By displacing the retainer plate 64 (to the left in FIG. 7), the front edges 68 of the cam plates eject the yarn from the slot 66. Accordingly, the yarn is engaged by the traversing guide 28 (or 28') and traversed along the package axis to form a transfer tail.

As described earlier herein, however, a problem can arise once the yarn has been inserted into the pinch groove of the tube because as the yarn begins to be wound, slack may be produced in the threadline which causes the yarn to slide out of the slot in the tail making guide. Hence, the waste bunch may not be properly formed.

In accordance with the present invention, there is mounted on the winder head 22 a gate 80 disposed on a side of the slot 66 opposite the cam edges 68. The gate 80 includes a projection 82 which is positioned to overlie a yarn Y disposed in the slot 66 when such slot is moved to a position (to the right as viewed in FIG. 6) from its normal yarn-receiving position.

Figure 6:
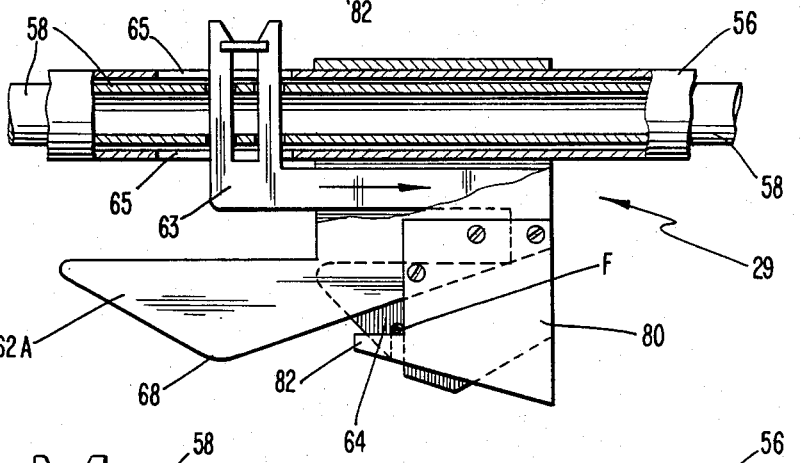
FIG. 6 is a view similar to FIG. 5 after the receiver plate has been shifted in a manner producing a blockage of the yarn against egress from the slot.

Such movement is effected by providing a movable stop pin 86 (FIG. 2) behind the actuating piston 70. The stop pin 86 extends through a block 88, the latter being attached to an air-driven regulating piston 90. The piston 90 is movable parallel to the actuating piston 70 in a chamber 92 which communicates with pressurized air via an inlet 94. The block 88 isolates the chamber 92 from the chamber 72. A coil compression spring 96 biases the regulating piston 90 and its stop pin 86 to a stop position (FIG. 3) which prevents the slot 66 from being moved beneath the gate projection 82 under the action of the actuating spring 60. However, under the urging of air pressure from inlet 94, the regulating piston 90 and the stop pin 86 are displaced (to the right as viewed in FIG. 2) to enable the actuating spring 60 to displace the actuating piston 70 and thereby shift the retainer plate 64 and slot 66 toward the gate 80. Hence, the yarn F which is seated in the slot 66 will be prevented from exiting therefrom by means of the projection 82 (FIGS. 2 and 6).

When threading of the yarn into the pinch groove of the tube occurs, the yarn will be inescapably contained within the slot 66. As the tube T rotates the yarn, any initial slackening of the yarn is not able to flip the yarn out of the slot 66, due to the blockage of the yarn by the gate 80.

After a prescribed winding interval has taken place (during which interval the waste bunch is wound), the normal actuation of the retainer plate 64 occurs whereby pressure from inlet 74 shifts the actuating piston 70 in a manner displacing the slot 66 beyond the front edges 68 of the cam plates 62A,B in order to eject the yarn from the slot 66 (FIG. 7). Thereafter, a normal oscillation of the yarn parallel to the package takes place.

IN OPERATION, a winding operation proceeds as depicted in FIG. 1, wherein one or more yarns F, F' are wound upon tubes T to form packages 18, 18'. During this winding operation, the yarns are oscillated parallel to the axis of the tubes by means of the reciprocating traverse guides 28, 28' and the grooved roll 24.

At the end of a winding sequence, the yarns F, F' are cut and aspirated to waste in any suitable manner. The winder head 22 is raised from the packages 18, 18', enabling the packages to be removed from the spindle and replaced by a pair of empty tubes T.

At this time, the tail making guides 29, 29' are oriented in the manner depicted in FIG. 4. That is, the slot 66 is exposed (unblocked), so that a yarn Y may be inserted therein as depicted in FIG. 5. This is done prior to threading of the yarn onto the empty tube T. Once the yarn has been inserted into the slot 66, fluid pressure is admitted to the working side of the chamber 92 via inlet 94 to push the regulating piston 90 and the stop pin 86 away from the actuating piston 70 (i.e., from the position depicted in FIG. 3 to the position depicted in FIG. 2). This enables the spring 60 to shift the rod 58, the working piston 70, and the retainer plate 64, the latter being moved to a position wherein the yarn F is situated behind the projection 82 of the gate 80, as depicted in FIG. 6, and is thus blocked from leaving the slot 66.

Thereafter, the yarn is inserted into the pinch groove of the empty tube T. Since the yarn is blocked from exiting the slot 66 by means of the gate 80, there is no chance that any slackening of the yarn, caused by initial rotation of the yarn by the tube T, can inadvertently dislodge the yarn from the slot 66. As a result, it is assured that a proper waste bunch and transfer tail will be formed at the end of each tube.

After a prescribed interval, fluid pressure is introduced into the chamber 72 of the housing 52 via the inlet 74. This causes the actuating piston 70 to shift in a direction (to the left in FIG. 2) displacing the slot 66 beyond the camming edges 68 of the cam plates 62A, 62B. This causes the yarn to be ejected from the slot, whereupon it is oscillated in the appropriate manner by the traverse guide 28 (or 28') and the grooved roll 24.

It will be appreciated that the present invention insures that the slack produced in the yarn during the initial winding of the yarn will not cause the yarn to exit the slot of the tail making guide. Thus, a proper waste bunch and transfer tail are formed upon the end of the tube. Each filled package will be suitable for connection with the leading yarn end of a subsequent package to effect a continuous uninterrupted processing of the yarn.

It will be appreciated that the present invention is suitable for use in winders which are serviced by automatic cutting/aspirating mechanisms or robots, as well as winders which are serviced manually.

Although the present inventoin has been described in connection with a preferred embodiment thereof, it will be appreciated by those skilled in the art that modifications, substitutions, additions, and deletions not specifically described may be made, without departing from the spirit and scope of the invention as defined in the appended claims.

What is claimed is:

1. A winder for filamentary material, comprising:

means for rotating a tube about a longitudinal axis to wind-up filamentary material, traversing means for guiding the filamentary material for traversing movement along the tube axis to effect a helical winding of the filamentary material upon the tube, and tail making means including:

constraining means for receiving the filamentary material and constraining the filamentary material against traversing movement along the tube axis during an initial winding interval of the filamentary material on the tube to form a waste bunch of filamentary material at an end of the tube, blocking means for blocking egress of the filamentary material from said constraining means during said initial winding interval, and ejecting means for displacing the filamentary material from said constraining means at the end of said initial winding interval, whereupon the filamentary material is traversed by said traversing means, said ejecting means including a stationary cam plate having a camming edge, said constraining means comprises a retainer plate carrying a slot, said retainer plate being positionable in a rest position to receive filamentary material within said slot and movable in a first direction relative to said cam plate to move said slot past said camming edge such that the latter pushes filamentary material from said slot, said blocking means comprising a stationary gate positioned such that movement of said retainer plate in a second direction from said rest position locates the filamentary material relative to said gate such that said gate blocks egress of the filamentary material from said slot, and means for moving said retainer plate in said first and second directions.

2. A winder according to claim 1, wherein said moving means comprises a piston connected to said retainer plate, a spring biasing said piston toward a stop member to move said retainer plate in said second direction, means for directing pressurized fluid against said piston to move said retainer plate in said first direction against said spring bias, and means for movably adjusting said stop element to enable said spring to move said retainer plate to a position where said slot is closed-off by said gate.

3. A winder for filamentary material comprising:

means for rotating a tube about a longitudinal axis to wind-up filamentary material being fed to the tube, traversing means for oscillaing the filamentary material parallel to said longitudinal axis as winding proceeds, to produce a helical winding of the filamentary material on the tube, and a tail making guide comprising:

a retainer plate including a slot, said slot opening toward the path of travel of the filamentary material to receive the latter and constrain same against movement parallel to said longitudinal axis during an initial winding interval, to form a waste bunch of filamentary material at an end of the tube, a cam plate having a camming edge disposed adjacent said retainer plate, a gate mounted adjacent said retainer plate, and actuator means for effecting relative movement between said retainer plate and said gate to locate said gate in blocking relationship relative to the filamentary material and prevent egress of same from said slot during said initial winding interval, and for effecting relative movement between said retainer plate and said cam plate such that said camming edge pushes the filamentary material out of said slot at the end of said initial winding interval to enable the filamentary material to be engaged by said traversing means and form a transfer tail of filamentary material.

4. A winder according to claim 3, wherein said actuator means is operably connected to move said retainer plate toward said cam plate in one direction and toward said gate in the opposite direction.

5. A winder according to claim 4, wherein said actuator means comprises a piston connected to said retainer plate, means for directing pressurized fluid against said piston to move said retainer plate in said one direction to effect discharge of filamentary material from said slot, spring means biasing said piston toward a stop element to move said retainer plate in said opposite direction, and means for adjusting said stop element to enable said piston to travel sufficiently far in said opposite direction to cause the filamentary material to be blocked-off by said gate.

6. A method of initiating the winding of filamentary material upon a winder tube comprising the steps of:

inserting filamentary material into a slot which prevents movement of the filamentary material along the axis of the winder tube, producing relative movement between said slot and a blocking element such that said blocking element prevents egress of the filamentary material from said slot, inserting said filamentary material into a pinch groove of said winder tube, rotating said winder tube a preset interval to form a waste bunch of filamentary material on said tube, producing relative movement between said slot and said blocking element to permit egress of the filamentary material from said slot, and ejecting the filamentary material from said slot and traversing same along the axis of said tube as winding proceeds.

* * * * *